US005885952A

United States Patent [19]

Kuratli et al.

[11] Patent Number: 5,885,952

[45] **Date of Patent: *Mar. 23, 1999**

[54] MULTIFUNCTIONAL DETERGENT BASE

[75] Inventors: Rolf Kuratli, Basel, Switzerland; Claude Eckhardt, Riedisheim, France; Frank Bachmann, Freiburg, Germany; Werner Schreiber, Basel, Switzerland

[73] Assignee: Ciba Specialty Chemicals Corporation, Tarrytown, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 649,938

[22] Filed: May 15, 1996

[30] Foreign Application Priority Data

May 19, 1995 [CH] Switzerland ..... 1494/95

[51] Int. Cl.[6] ..... D06M 13/165

[52] U.S. Cl. ..... 510/340; 510/317; 510/356; 510/351; 510/535; 510/537; 510/524; 568/607; 568/608; 568/613; 568/616

[58] Field of Search ..... 510/340, 495, 510/356, 351, 535, 317, 537, 524; 568/607, 608, 613, 616

[56] References Cited

U.S. PATENT DOCUMENTS

| | | | |
|---|---|---|---|
| 3,149,078 | 9/1964 | Zmoda | 252/137 |
| 3,210,286 | 10/1965 | Gangwisch | 252/137 |
| 3,214,380 | 10/1965 | Gangswisch | 252/100 |
| 3,579,456 | 5/1971 | Cambre | 252/137 |
| 3,623,990 | 11/1971 | Cambre | 252/137 |
| 3,677,954 | 7/1972 | Nakajima | 252/151 |
| 3,813,349 | 5/1974 | Wolfson | 252/526 |
| 4,124,523 | 11/1978 | Johnson | 252/142 |
| 4,129,527 | 12/1978 | Clark et al. | 252/547 |
| 4,457,856 | 7/1984 | Mitchall et al. | 252/166 |
| 4,612,352 | 9/1986 | Schäfer et al. | 524/404 |
| 4,963,629 | 10/1990 | Driemel et al. | 526/200 |
| 5,032,659 | 7/1991 | Heidel | 527/300 |
| 5,227,446 | 7/1993 | Denzinger et al. | 527/314 |
| 5,456,847 | 10/1995 | Guth et al. | 252/8.9 |

*Primary Examiner*—José G. Dees
*Assistant Examiner*—Sabiha N. Qazi
*Attorney, Agent, or Firm*—Kevin T. Mansfield

[57] ABSTRACT

A detergent base which is obtainable from the reaction of an ethylenically unsaturated sulfonic acid or carboxylic acid or anhydride thereof with a nonionic surfactant of the formula $$R_1\text{—O-(alkylene-O)}_{n_1}\text{—}R_2 \quad (1)$$

in which $R_1$ is $C_8$–$C_{22}$alkyl or $C_8$–$C_{18}$alkenyl;

$R_2$ is hydrogen, $C_1$–$C_4$alkyl, a cycloaliphatic radical having at least 6 C atoms or benzyl; and $n_1$ is a number from 1 to 60;

and if appropriate with sugar derivatives.

The detergent base has a good calcium-dispersing power, is very stable to electrolytes and heat and has an excellent washing action and anti-redeposition properties. It is therefore suitable for the preparation of powder and liquid detergents.

13 Claims, No Drawings

MULTIFUNCTIONAL DETERGENT BASE

The present invention relates to a multifunctional detergent base, the preparation of this base, its use in domestic detergents, and domestic detergents comprising the detergent base.

In addition to builders (zeolites/laminar silicates), bleaches or bleaching systems (perborate/percarbonate plus TAED), fluorescent whiteners and enzymes, surfactants of the alkylbenzenesulfonate (LAS), fatty alcohol sulfate, soap and fatty alcohol ethoxylate type are employed today for the preparation of detergents for domestic laundry, for example washing powders. Components which are furthermore used are polycarboxylates (polyacrylic acids) for improving the washing result and the calcium-complexing power, and foam inhibitors (silicone/paraffin compounds) for reducing foam. Such a pulverulent detergent has, for example, the following composition:

($a_1$) 6 to 12% by weight of alkylbenzenesulfonate (LAS), ($a_2$) 0 to 7% by weight of secondary alkanesulfonates, ($a_3$) 3 to 9% by weight of nonionic surfactants, ($a_4$) 0 to 5% by weight of cationic, zwitterionic and/or amphoteric surfactants, ($a_5$) 0 to 2% by weight of soap, ($a_6$) 2 to 6% by weight of polymers and (b) 17 to 46% by weight of zeolite or sodium tripolyphosphate, (c) 2 to 6% by weight of sodium silicate or laminar silicate, which may be impregnated with cationic softener, (d) 0 to 2% by weight of magnesium silicate, (e) 0.8 to 1.2% by weight of carboxymethylcellulose (CMC), (f) 0.2 to 0.6% by weight of phosphonate, (g) 0 to 25% by weight of sodium sulfate, (h) 5 to 15% by weight of sodium carbonate, (i) 15 to 25% by weight of sodium perborate tetrahydrate or, in particular, monohydrate or percarbonate (k) 3 to 5% by weight of peroxide activator, for example TAED, NOBS, TAGU and the like (l) 0.01 to 0.5% by weight of foam inhibitors and (m) 0.01 to 2% by weight of perfume oil, fluorescent whiteners, dyes (n) 0 to 2% by weight of enzymes, (o) 0.5 to 2% by weight of dye transfer inhibitors, for example polyvinylpyrrolidone (molecular weight 40,000)

(p) 5 to 17% by weight of sodium citrate and to 100% of water.

Surprisingly, it has now been found that reaction products of an ethylenically unsaturated sulfonic acid or carboxylic acid or anhydride thereof and certain nonionic surfactants and, if appropriate, sugar derivatives are detergent bases which are capable of replacing components ($a_1$)–($a_6$) mentioned in the above washing powder composition entirely and components (b), (e), (l) and (n) entirely or in part.

The present invention therefore relates to a detergent base which is obtainable from the reaction of, based on the total weight of the detergent base, 2.5 to 19.6% by weight of an ethylenically unsaturated sulfonic acid or carboxylic acid or anhydride thereof, 20 to 95% by weight of a nonionic surfactant of the formula $$R_1—O—(\text{alkylene-O})_{n_1}—R_2 \quad (1)$$

in which $R_1$ is $C_8$–$C_{22}$alkyl or $C_8$–$C_{18}$alkenyl;

$R_2$ is hydrogen; $C_1$–$C_4$alkyl; a cycloaliphatic radical having at least 6 C atoms or benzyl; "alkylene" is an alkylene radical having 2 to 4 carbon atoms; and $n_1$ is a number from 1 to 60;

and 0 to 60% by weight of sugar derivatives.

Because of their low tendency to foam, especially if fatty alcohol ethoxylates having a low degree of ethoxylation, for example $C_{13}$-oxo alcohols having 4 to 6 ethylene oxide units, are employed as nonionic surfactants of the formula (1), the addition of foam inhibitors (component (l)) customary in washing powder compositions can be omitted.

The detergent base according to the invention furthermore has excellent anti-redeposition properties, so that the addition of anti-redeposition agents, for example carboxymethyl-cellulose and/or polyacrylic acid, can be omitted in detergents which comprise this detergent base (cf. Examples 21 to 23).

Substituents $R_1$ and $R_2$ in the formula (1) are advantageously the hydrocarbon radical of an unsaturated or preferably saturated aliphatic monoalcohol having 8 to 22 carbon atoms. The hydrocarbon radical can be straight-chain or branched. Preferably, $R_1$ and $R_2$ are an alkyl radical having 9 to 14 C atoms.

Aliphatic saturated monoalcohols are naturally occurring alcohols, for example lauryl alcohol, myristyl alcohol, cetyl alcohol or stearyl alcohol, and synthetic alcohols, for example 2-ethylhexanol, 1,1,3,3-tetramethylbutanol, octan-2-ol, isononyl alcohol, trimethylhexanol, trimethylnonyl alcohol, decanol, $C_9$–$C_{11}$oxo alcohol, tridecyl alcohol, isotridecyl alcohol or linear primary alcohols (Alfols) having 8 to 22 carbon atoms. Some representatives of these Alfols are Alfol (8–10), Alfol (9–11), Alfol (10–14), Alfol (12–13) or Alfol (16–18). ("Alfol" is a registered trademark.)

Unsaturated aliphatic monoalcohols are, for example, dodencenyl alcohol, hexadecenyl alcohol or oleyl alcohol.

The alcohol radicals cam be present individually or in the form of mixtures of two or more components, for example mixtures of alkyl and/or alkenyl groups which are derived from soya fatty acids, palm kernel fatty acids or tallow oils. (alkylene-O)-chains are preferably divalent radicals of the formulae $$-(CH_2-CH_2-O)-,\quad -(\overset{\overset{\displaystyle CH_3}{|}}{CH}-CH_2-O)- \quad \text{or}$$

$$-(CH_2-\overset{\overset{\displaystyle CH_3}{|}}{CH}-O)-.$$

Examples of a cycloaliphatic radical are cycloheptyl, cyclooctyl or, preferably, cyclohexyl. Nonionic surfactants are preferably compounds of the formula (2)

$$R_3-O-(\overset{\overset{\displaystyle Y_1}{|}}{CH}-\overset{\overset{\displaystyle Y_2}{|}}{CH}-O)_{n_2}-(\overset{\overset{\displaystyle Y_3}{|}}{CH}-\overset{\overset{\displaystyle Y_4}{|}}{CH}-O)_{n_3}-R_4$$

in which $R_3$ is $C_8$–$C_{22}$alkyl;

$R_4$ is hydrogen or $C_1$–$C_4$alkyl;

$Y_1$, $Y_2$, $Y_3$ and $Y_4$, independently of one another are hydrogen, methyl or ethyl;

$n_2$ is a number from 0 to 8; and $n_3$ is a number from 2 to 40.

Other important nonionic surfactants are those of the formula (3)

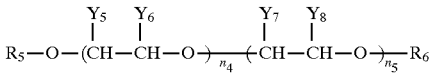

in which $R_5$ is $C_9$–$C_{14}$alkyl;

$R_6$ is $C_1$–$C_4$alkyl;

$Y_5$, $Y_6$, $Y_7$ and $Y_8$, independently of one another are hydrogen, methyl or ethyl, where one of the radicals $Y_5$, $Y_6$ or $Y_7$, $Y_8$ is always hydrogen; and $n_4$ and $n_5$, independently of one another are an integer from 4 to 8.

The nonionic surfactants of the formulae (1) to (3) can be employed as mixtures. Thus, for example, surfactant mixtures are fatty alcohol ethoxylates of the formula (1) which do not have closed end groups, i.e. compounds of the formula (1) in which $R_1$ is $C_8$–$C_{22}$alkyl, $R_2$ is hydrogen and the alkylene-O-chain is the radical —($CH_2$—$CH_2$—O)— and fatty alcohol ethoxylates of the formula (3) which have closed end groups.

Examples of the nonionic surfactants of the formulae (1), (2) or (3) are reaction products of a $C_{10}$–$C_{13}$-fatty alcohol, for example a $C_{13}$oxo alcohol, with 3 to 10 mol of ethylene oxide, propylene oxide and/or butylene oxide, with a reaction product of 1 mol of a $C_{13}$-fatty alcohol with 6 mol of ethylene oxide and 1 mol of butylene oxide, it being possible in each case for the addition products to have end groups closed by $C_1$–$C_4$alkyl, preferably methyl or butyl.

The nonionic surfactants of the formula (1) are prepared in a manner known per se, for example by reaction of a fatty alcohol with alkylene oxides. The corresponding nonionic surfactants which have closed end groups are prepared by subsequent reaction of the resulting adduct with an alkyl halide $R_2$-Hal, $R_4$-Hal or $R_6$-Hal, preferably with $C_1$–$C_4$alkyl chloride.

Both monocarboxylic acids and dicarboxylic acids and anhydrides thereof, as well as sulfonic acids which in each case contain an ethylenically unsaturated aliphatic radical and preferably not more than 7 carbon atoms, can be employed as ethylenically unsaturated monomeric sulfonic acids or carboxylic acids or anhydrides thereof which are suitable for reaction with the nonionic surfactants of the formulae (1) to (3). Monocarboxylic acids having 3 to 5 carbon atoms, for example acrylic acid, methacrylic acid, α-haloacrylic acid, 2-hydroxyethylacrylic acid, α-cyanoacrylic acid, crotonic acid and vinylacetic acid, are preferred. Ethylenically unsaturated dicarboxylic acids are preferably fumaric acid, maleic acid or itaconic acid, and furthermore mesaconic acid, citraconic acid, gluconic acid and methylmalonic acid. Maleic anhydride may be mentioned in particular as an anhydride of these acids.

Monomeric sulfonic acids which are used for the reaction are, for example, vinylsulfonic acid or 2-acrylamido-2-methylpropanesulfonic acid.

Sugar derivatives are monosaccharides, disaccharides, trisaccharides or oligosaccharides. In the context of the present invention, monosaccharide is to be understood as meaning an aldopentose, aldohexose, aldotreose, ketopentose or ketohexose. The compounds mentioned can also be in the form of lactones, for example D(+)-gluconic acid 67-lactone. Examples of an aldopentose are D-ribose, D-arabinose, D-xylose or D-lyose; examples of an aldohexose are D-allose, D-altrose, D-glucose, D-mannose, D-gulose, D-idose, D-galactose, D-talose, L-fucose or L-rhamnose; examples of a ketopentose are D-ribulose or D-xylulose; examples of a tetrose are D-erythrose or threose; and examples of a ketohexose are D-psicose, D-fructose, D-sorbose or D-tagatose.

Examples of a disaccharide are trehalose, maltose, isomaltose, cellobiose, gentiobiose, saccharose, lactose, chitobiose, N,N-diacetylchitobiose, palatinose or sucrose.

Example of a trisaccharide are raffinose, panose or maltotriose.

Examples of an oligosaccharide are maltotetraose, maltohexaose and chitoheptaose. Particularly preferred sugar derivatives are enolizable saccharides, for example fructose or palatinose. Sugar acids, for example gluconic acids (D-gluconic acid and salts thereof), glucaric acids (mucic acid), and glucuronic acids (D-glucuronic acid and D-galacturonic acid) can also be used according to the invention. The individual components are preferably employed in the following amounts for the reaction:

50 to 90% by weight of one or more nonionic surfactants, 5 to 13% by weight of an ethylenically unsaturated sulfonic acid or carboxylic acid or anhydride thereof, 0 to 30% by weight of sugar derivatives and 1 to 60, in particular 1 to 20% of water.

The detergent base according to the invention preferably corresponds to the reaction product of 5 to 13% by weight of acrylic acid or methacrylic acid and 50 and 90% by weight of the nonionic surfactant of the formula (2) and 0 to 30% by weight of gluconic acid.

The detergent base according to the invention is prepared by reaction of the nonionic surfactant of the formula (1) with an ethylenically unsaturated sulfonic acid or carboxylic acid or anhydride thereof at temperatures from 30 to 100 C, preferably 80 to 95 C, using a catalyst.

In particular, the ratio of nonionic surfactant or several nonionic surfactants to ethylenically unsaturated sulfonic acid or carboxylic acid or anhydride thereof is 8:1 to 1:1, in particular 6:1 to 3:1.

The reaction is advantageously carried out in an inert atmosphere, for example in the presence of nitrogen.

Organic initiators which form free radicals are preferably used as catalysts for this reaction. Suitable initiators for carrying out the free radical polymerization are, for example, symmetric aliphatic azo compounds, such as azo-bis-isobutyronitrile, azo-bis-2-methylvaleronitrile, 1,1-azo-bis-1-cyclohexanenitrile and 2,2-azo-bis-isobutyric acid alkyl esters; symmetric diacyl peroxides, for example acetyl, propionyl or butyryl peroxide, benzoyl peroxide, bromo-, nitro-, methyl- or methoxy-substituted benzoyl peroxides and lauroyl peroxides; symmetric peroxydicarbonates, for example diethyl, diisopropyl, dicyclohexyl and dibenzyl peroxydicarbonate; tert-butyl peroctoate, tert-butyl perbenzoate or tert-butylphenyl peracetate, and peroxydicarbamates, such as tert-butyl N-(phenylperoxy)-carbamate or tert-butyl N-(2,3-dichloro- or 4-chlorophenyl-peroxy)-carbamate. Other suitable peroxides are: tert-butyl hydroperoxide, di-tert-butyl peroxide, cumene hydroperoxide, di-cumene peroxide and tert-butyl perpivalate. Another suitable compound is potassium persulfate, which is preferably employed for the preparation of the detergent base according to the invention.

The catalysts are as a rule employed in amounts of 0.01 to 1% by weight, based on the starting substances.

In another preparation variant, the ethylenically unsaturated sulfonic acid or carboxylic acid is initially introduced into the reaction vessel in a high concentration in a first stage and the fatty alcohol ethoxylate and, if appropriate, the sugar derivative are then incorporated into the formulation.

After the reaction, the reaction product obtained is partly neutralized to a pH of 3 to 10, preferably 4 to 5, with an inorganic and/or organic base, for example sodium hydroxide solution, potassium hydroxide solution, magnesium hydroxide, ethanolamine or triethanolamine. Bases which are used are, for example, 1 to 8% by weight inorganic or organic bases, for example sodium hydroxide, magnesium hydroxide, ethanolamine, triethanolamine, N,N,N,N-tetrakis (2-hydroxypropyl)-ethyleneamine or 1 -amino-1 -deoxysorbitol, or mixtures thereof. Water is added to 100% by weight.

Further auxiliaries, for example hydrotropic agents, higher fatty alcohols and the like, can be incorporated after the reaction in order to improve the specific properties, for example flow properties, foam properties and the like.

The detergent base according to the invention has a good calcium-dispersing power, i.e. additional amounts of polycarboxylates in the subsequent detergent are no longer necessary. It is furthermore very stable to electrolytes and heat. It has an excellent washing action. The formation of macromicelles at elevated temperature is eliminated by the polymerization.

The detergent base is therefore outstandingly suitable for the preparation of domestic detergents, for example powder or liquid detergents, by the customary processes. The invention furthermore relates to the use of the detergent base according the invention for preparation for of domestic detergents.

The invention also relates to a domestic detergent. This comprises (a) 5 to 35% by weight of a detergent base obtainable from the reaction of an ethylenically unsaturated sulfonic acid or carboxylic acid or anhydride thereof with a nonionic surfactant of the formula $$R_1—O\text{-}(Alkylen\text{-}O)_{n_1}—R_2 \quad (1)$$

in which $R_1$ is $C_8$–$C_{22}$alkyl or $C_8$–$C_{18}$alkenyl;

$R_2$ is hydrogen; $C_1$–$C_4$alkyl; a cycloaliphatic radical having at least 6 C-atoms or benzyl;

"alkylene" is an alkylene radical having 2 to 4 carbon atoms; and $n_1$ is a number from 1 to 60;

and if appropriate with sugar derivatives, (b) 7 to 46% by weight of zeolite or sodium tripolyphosphate, (c) 2 to 6% by weight of sodium silicate or laminar silicate, if appropriate impregnated with cationic softener, (d) 0.8 to 1.2% by weight of carboxymethylcellulose (CMC), (e) 0.2 to 0.6% by weight of phosphonate, (f) 5 to 15% by weight of sodium carbonate, (g) 15 to 25% by weight of sodium perborate compounds, (h) 3 to 5% by weight of peroxide activator, (i) 0.5 to 2% by weight of dye transfer inhibitors, (k) 5 to 17% by weight of sodium citrate, (l) 0.01 to 2% by weight of additives and to 100% , water.

Sodium perborate compounds (component (g)) are, for example, sodium perborate tetrahydrate or, in particular, sodium perborate monohydrate or sodium perborate percarbonate.

Peroxide activators (component (h)) are, for example, TAED, NOBS or TAGU.

Additives (component (l)) are, for example, perfume oil, fluorescent whiteners or dyes.

The detergent according to the invention can furthermore comprise, as components which may possibly be present, (m) 0 to 2% by weight of magnesium silicate, (n) 0 to 25% by weight of sodium sulfate, (o) 0 to 0.5% by weight of foam inhibitors and (p) 0 to 2% by weight of enzymes.

Since the detergent base according to the invention simultaneously replaces the components of LAS, nonionic surfactant, defoamer, complexing agent and fatty alcohol sulfate, the use of only one component facilitates metering in the detergent composition and leads to a simplification of the preparation process for the washing powder.

Another variability of the detergent in respect of its properties can be achieved by using different nonionic surfactants of the formula (1), (2) or (3) for the preparation of the detergent base according to the invention. For example, the wetting power, the washing action or the foaming properties can be adjusted by using corresponding nonionic surfactants. The complexing action and the washing action can be controlled via the amount of ethylenically unsaturated sulfonic acids or carboxylic acids employed. The sugar-acrylic acid polymers are known complexing agents of very good biological degradeability and therefore also allow the calcium-dispersing power to be adjusted.

The following examples serve to illustrate the invention.

A. Preparation of the detergent bases according to the invention

EXAMPLE 1

555.7 g of deionized water, 119.9 g of adduct from one part of a $C_{13}$-oxo alcohol and 9 parts of EO and 75.70 g of adduct from one part of a $C_{13}$-oxo alcohol and 10 parts of EO are initially introduced into a 1 liter reaction vessel with a heating jacket at 20°–30° C. and are heated up to 90° C.

At an internal temperature of 90 C, 195.6 g of acrylic acid, in the course of 3 hours, and 1.2 g of potassium persulfate, dissolved in 29.0 g deionized water, in the course of 195 minutes, are simultaneously metered in.

When metering of the catalyst solution has ended, the mixture is subsequently stirred at 90 C for a further 30 minutes and then cooled to room temperature. At an internal temperature of 70° C., 22.9 g of sodium hydroxide solution (30%) are added and the mixture is stirred until a clear homogeneous solution is formed.

EXAMPLE 2

80.8 g of deionized water, 750.0 g of adduct from one part of a $C_{9-11}$-fatty alcohol and 4 parts of EO are initially introduced into a 1 liter reaction vessel with a heating jacket at 20°–30° C. and are heated up to 90° C.

At an internal temperature of 90° C., 125.0 g of acrylic acid, in the course of 3 hours, and 1.2 g of potassium persulfate, dissolved in 29.0 g of deionized water, in the course of 195 minutes, are simultaneously metered in.

When metering of the catalyst solution has ended, the mixture is subsequently stirred at 90 C for a further 30 minutes and then cooled to room temperature.

At an internal temperature of 70° C., 14.0 g of sodium hydroxide solution (30% strength) are added and the mixture is stirred until a clear, homogeneous solution is formed.

EXAMPLE 3

80.8 g of deioinized water.

450.0 g of adduct from one part of a $C_{9-11}$-fatty alcohol and 4 parts of EO and 300.0 g of adduct from one part of a decyl alcohol and 3 parts of EO are initially introduced into a 1 liter reaction vessel with a heating jacket at 20°–30° C. and are heated up to 90 C.

At an internal temperature of 90° C., 125.0 g of acrylic acid, in the course of 3 hours, and 1.2 g of potassium persulfate, dissolved in 29.0 g of deionized water, in the course of 195 minutes, are simultaneously metered in.

When metering of the catalyst solution has ended, the mixture is subsequently stirred at 90 C for a further 30 minutes and then cooled to room temperature.

At an internal temperature of 70° C., 14.0 g of sodium hydroxide solution (30% ) are added and the mixture is stirred until a clear, homogeneous solution is formed.

EXAMPLE 4

80.8 g of deionized water, 520.0 g of adduct from one part of a $C_{11}$-fatty alcohol and 3 parts of EO and 239.0 g of adduct from one part of a $C_{11}$-fatty alcohol and 5 parts of EO are initially introduced into a 1 liter reaction vessel with a heating jacket at 20°–30° C. and are heated up to 90 C.

At an internal temperature of 90° C., 125.0 g of acrylic acid, in the course of 3 hours, and 1.2 g of potassium persulfate, dissolved in 29.0 g of deionized water, in the course of 195 minutes, are simultaneously metered in.

When metering of the catalyst solution has ended, the mixture is subsequently stirred at 90 C for a further 30 minutes and then cooled to room temperature.

At an internal temperature of 70° C., 14.0 g of sodium hydroxide solution (30% ) are added and the mixture is stirred until a clear, homogeneous solution is formed.

EXAMPLE 5

157.5 g of deionized water, 208.0 g of adduct from one part of a $C_3$-oxoalcohol and 3 parts of EO, 208.0 g of adduct from one part of a $C_{13}$-oxoalcohol and 10 parts of EO and 208.0 g of adduct from one part of a decyl alcohol and 6 parts of EO/4 parts of PO are initially introduced into a 1 liter reaction vessel with a heating jacket at 20°–300° C. and are heated up to 90 C.

At an internal temperature of 90° C., 187.0 g of acrylic acid, in the course of 3 hours, and 1.5 g of potassium persulfate, dissolved in 30.0 g of deionized water, in the course of 195 minutes, are simultaneously metered in.

When metering of the catalyst solution has ended, the mixture is subsequently stirred at 90 C for a further 30 minutes and then cooled to room temperature.

EXAMPLE 6

94.8 g of deionized water, 375.0 g of adduct from one part of a $C_{11}$-fatty alcohol and 3 parts of EO and 375.0 g of adduct from one part of a $C_{11}$-fatty alcohol and 5 parts of EO are initially introduced into a 1 liter reaction vessel with a heating jacket at 20°–30° C. and are heated up to 90 C.

At an internal temperature of 90° C., 125.0 g of acrylic acid, in the course of 3 hours, and 1.2 g of potassium persulfate, dissolved in 29.0 g of deionized water, in the course of 195 minutes, are simultaneously metered in.

When metering of the catalyst solution has ended, the mixture is subsequently stirred at 90 C for a further 30 minutes and then cooled to room temperature.

EXAMPLE 7

154.0 g of deionized water, 375.0 g of adduct from one part of a $C_{13}$-oxo alcohol and 6 parts of EO, 156.0 g of adduct from one part of a decyl alcohol and 6 parts of EO/4 of PO and 78.0 g of sodium gluconate are initially introduced into a 1 liter reaction vessel with a heating jacket at 20°–30° C. and are heated up to 90 C.

At an internal temperature of 90° C., 195.0 g of acrylic acid, in the course of 3 hours, and 2.0 g of potassium persulfate, dissolved in 40.0 g of deionized water, in the course of 195 minutes, are simultaneously metered in.

When metering of the catalyst solution has ended, the mixture is subsequently stirred at 90 C for a further 30 minutes and then cooled to room temperature.

EXAMPLE 8

66.0 g of deionized water, 375.0 g of adduct from one part of a $C_{13}$-oxoalcohol and 6 parts of EO, 156.0 g of decyl alcohol-6EO/4PO and 78.0 g of sodium gluconate are initially introduced into a 1 liter reaction vessel with a heating jacket at 20°–30° C. and are heated up to 90 C.

At an internal temperature of 90° C., 195.0 g of acrylic acid, in the course of 3 hours, and 4.8 g of potassium persulfate, dissolved in 125.0 g of deionized water, in the course of 195 minutes, are simultaneously metered in.

When metering of the catalyst solution has ended, the mixture is subsequently stirred at 90 C for a further 30 minutes and then cooled to room temperature.

EXAMPLE 9

193.8 g of deionized water, 375.0 g of adduct from one part of a $C_{13}$-oxo alcohol and 6 parts of EO, 156.0 g of adduct from one part of a decyl alcohol and 6 parts of EO/4PO and 50.0 g of D-gluconic acid lactone are initially introduced into a 1 liter reaction vessel with a heating jacket at 20°–30° C. and are heated up to 90 C.

At an internal temperature of 90 C, 195.0 g of acrylic acid, in the course of 3 hours, and 1.2 g of potassium persulfate, dissolved in 29.0 g of deionized water, in the course of 195 minutes, are simultaneously metered in.

When metering of the catalyst solution has ended, the mixture is subsequently stirred at 90 C for a further 30 minutes and then cooled to room temperature.

EXAMPLE 10

417.00 g of adduct from one part of a $C_{11}$-oxo alcohol and 3 parts of EO, 417.00 g of adduct from one part of a $C_{11}$-oxo alcohol and 5 parts of EO and 10.00 g of adduct from one part of a $C_{13}$-oxo alcohol and 10 parts of EO are initially introduced into a 1 liter reaction vessel with a heating jacket at 20°–30° C. and are heated up to 90 C At an internal temperature of 90 C, 105.0 g of acrylic acid, in the course of 3 hours, and 2.0 g of potassium persulfate, dissolved in 49.0 g of deionized water, in the course of 195 minutes, are simultaneously metered in.

When metering of the catalyst solution has ended, the mixture is subsequently stirred at 90 C for a further 30 minutes and then cooled to room temperature.

EXAMPLE 11

343.0 g of deionized water.

76.0 g of adduct from one part of a $C_{13}$-oxo alcohol and 9 parts of EO, 48.0 g of adduct from one part of a $C_{13}$-oxo alcohol and 10 parts of EO and 368.0 g of adduct from one part of a $C_{10}$-fatty alcohol and 6 parts of EO/1 of BuO-methyl ether are initially introduced into a 1 liter reaction vessel with a heating jacket at 20°–30° C. and are heated to 90 C.

At an internal temperature of 90 C, 124.0 g of acrylic acid, in the course of 3 hours, and 1.0 g of potassium persulfate, dissolved in 25.0 g of deionized water, in the course of 195 minutes, are simultaneously metered in.

When metering of the catalyst solution has ended, the mixture is subsequently stirred at 90 C for a further 30 minutes and then cooled to room temperature.

At an internal temperature of about 70 C, 15.0 g of sodium hydroxide solution (30% strength) are added and the mixture is cooled further.

The reaction products prepared in Examples 1 to 11 can be neutralized with sodium hydroxide solution, potassium hydroxide solution, organic amines (ethanolamine or triethanolamine), magnesium hydroxide and the like. It is possible to adjust the pH to between 3.0 and 10.0.

The water contained in the reaction product is preferably removed, if necessary, in a falling film evaporator.

Preparation of a powder detergent

EXAMPLE 12

A powder detergent is prepared by spray drying an aqueous slurry which comprises the following components:

zeolite, sodium carbonate, sodium silicate.

phosphonate and sodium sulfate.

Sodium tetraborate tetrahydrate or, preferably monohydrate or percarbonate,

TAAED and other admix components, such as fluorescent whiteners and the like, are then admixed to these spray granules in a fluidized-bed or ploughshare mixer. The detergent base obtainable from Examples 1 to 1 1 is then sprayed on, so that the final formulation comprises 5 to 35% by weight of the active detergent base. Finally, if appropriate, perfume oil is sprayed on.

EXAMPLE 13

The procedure described in Example 12 is repeated, except that a part amount of the detergent base obtainable from Examples 1 to 11 is admixed to the spray slurry. The final formulation comprises 5 to 35% by weight of the active detergent base.

EXAMPLE 14

The procedure described in Example 12 is repeated, except that the entire amount of the detergent base obtainable from Examples 1 to 11 is admixed to the spray slurry. The powder detergent comprises 5 to 35% by weight of the active detergent base.

EXAMPLE 15

The contents mentioned in Example 12 are granulated or mixed directly in a fluidized bed mixer or ploughshare mixer, and low-water or anhydrous detergent bases from Examples 1 to 11 are sprayed on. The content of active detergent base is 5 to 35% by weight.

EXAMPLE 16

All the solid components mentioned in Example 13 for the spray slurry are subjected to a mixing and grinding process, for example in a ploughshare mixer or in a fluidized bed. The detergent base and perfume oil are sprayed onto the resulting powder material so that compact granules of high bulk density are obtained. Finally, perborate tetra or, preferably monohydrate or percarbonate and an activator, such as TAED or NOBS, and, if appropriate, a protective silicate are admixed in the fluidized bed mixer or ploughshare mixer. A stable, non-tacky compact detergent is obtained.

EXAMPLE 17

The detergent base obtained from Examples 1 to 11 is diluted with water such that the final formulation comprises 50 to 58% by weight of active detergent base and has a viscosity favourable to the final consumer. Silicate, to establish a pH between 7.5 and 11, and perfume oil, fluorescent whiteners and, if appropriate, dyes are admixed to the solution. An "opacifier" can also be added. Very active, liquid heavy-duty detergents are obtained.

Use examples

EXAMPLES 18 to 20

5 washing baths (A-E) are prepared, each comprising 100 ml of deionized water, brought to pH 8.5 or 10.5 with NaOH, and the detergent bases to be tested, in the following concentrations (based on the active substance content):

washing bath A: no active substance washing bath B: 0.5 g/l washing bath C: 1 g/l washing bath D: 2 g/l washing bath E: 4 g/l 5 g pieces of the EMPA Standard Test Fabric No. 101 (cotton with olive oil/soot standard blacking) are introduced into in each case 100 ml of washing bath and washed at 60 C for 20 minutes, and then rinsed with deionized water for 30 seconds, spun and ironed at 160 C.

The brightness Y of the samples is measured spectrophotometrically both before and after washing. The difference AY before and after washing is a measure of the removal of dirt.

The washing results are shown in Table 1*a* and 1*b*.

TABLE 1a

| | ΔY values measured pH = 8.5 | | | | |
|---|---|---|---|---|---|
| | Washing bath A No active substance | Washing bath B 0.5 g/l | Washing bath C 1 g/l | Washing bath D 2 g/l | Washing bath E 4 g/l |
| Example 18: Detergent base from Example 5 | 3 | 10.5 | 19 | 21 | 30 |
| Example 19: Detergent base from Example 6 | 3 | 9 | 13 | 27 | 28 |
| Example 20: Detergent base from Example 7 | 3 | 10 | 12 | 25 | 29 |

TABLE 1b

| | ΔY values measured pH = 10.5 | | | | |
|---|---|---|---|---|---|
| | Washing bath A No active substance | Washing bath B 0.5 g/l | Washing bath C 1 g/l | Washing bath D 2 g/l | Washing bath E 4 g/l |
| Example 18: Detergent base from Example 5 | 4.5 | 15 | 20 | 27 | 27 |
| Example 19: Detergent base from Example 6 | 4.5 | 18 | 25.5 | 28.5 | 29 |
| Example 20: Detergent base from Example 7 | 4.5 | 25 | 28 | 27 | 29 |

The results from Tables 1*a* and 1*b* show that very good washing results are achieved with the detergent bases according to the invention.

EXAMPLES 21 to 23

Detergents as a rule comprise so-called "anti-redeposition agents", usually carboxymethylcellulose (CMC) and/or polyacrylic acid, sodium triphosphates also having such an anti-redeposition action.

The anti-redeposition properties are tested as follows: 5 g of bleached cotton test fabric are washed in 100 ml of deionized water with a pH of 10.5 (established with NaOH) at 60 C for 20 minutes, 40 mg of defined types of soot being added to the washing bath. The fabric is then rinsed briefly with tap water and dried at 60 C.

In each case 0.5 g/l of the active detergent bases from Examples 5, 6 and 7 are tested. Each test is carried out in duplicate, the brightness value Y being measured spectrophotometrically at 8 different points on the piece of textile and the average (=Ø) of the 16 measurement values and the standard deviation (=σ) being calculated. On the untreated cotton material, Y=93.0 (σ=0.1). The decrease in the brightness is a measure of the "deposition". The more effective the anti-redeposition action of a system, the lower this decrease, i.e. the higher the Y number.

The tests are carried out with the following types of soot:

a) ®Cabot SRF N762 from Cabot (iodine adsorption 30 mg/g; DBP absorption=65 ml/100 g; sieve residue=325 mesh=500 ppm, bulk density=505 g/dm$^3$).

b) ®Carax N 765 from Degussa (iodine adsorption=34 mg/g; DBP absorption=122 ml/100 g; sieve residue 325 mesh=500 ppm, bulk density=375 g/dm$^3$.

The washing results are shown in Table 2.

TABLE 2

| | Y values after one washing pass | | | |
|---|---|---|---|---|
| | ®Cabot SRF N762 | | ®Carax N765 | |
| | Ø | σ | Ø | σ |
| Example 21: Detergent base from Example 5 | 73.2 | 1.8 | 64.2 | 1.6 |
| Example 22: Detergent base from Example 6 | 70.8 | 2.4 | 68.7 | 2.2 |
| Example 23: Detergent base from Example 7 | 70.6 | 1.0 | 63.8 | 2.0 |

The results show that the detergent bases according to the invention show very good redeposition properties and can replace the otherwise commercial redeposition agents.

EXAMPLES 24 to 26

Surfactant solutions a) to c) are prepared, each comprising 2.0 g/l of the detergent base obtainable from Examples 5, 6 or 7 respectively. A total of 9 solutions are thus prepared.

Surfactant solutions a) to c) are prepared as follows:

a) with deionized water, b) with deionized water and addition of 5 g of olive oil per 50 ml of solution, c) adjustment of the water hardness to 15 dH [German hardness] by addition of the corresponding amount of solutions of $CaCl_2$ and $MgSO_4$ according to DIN 53905 50 ml of the surfactant solution are introduced into a glass cylinder of 4 cm diameter and 40 cm height at room temperature and the glass is closed with a plug. The glass is then turned on its head and turned back again manually 10×. The foam height is measured immediately and then at intervals of 30 seconds to 10 minutes.

The results are shown in Table 3.

TABLE 3

| | Test of the foam heights | | | | | |
|---|---|---|---|---|---|---|
| | Surfactant solution a) | | Surfactant solution b) | | Surfactant solution c) | |
| | imme-diately | after 10' | imme-diately | after 10' | imme-diately | after 10' |
| Example 24: Detergent base from Example 5 | 13 | 10 | 18 | 10 | 18 | 10 |
| Example 25: Detergent base from Example 6 | 15 | 10 | 42 | 30 | 17 | 10 |
| Example 26: Detergent base from Example 7 | 38 | 31 | 22 | 17 | 20 | 13 |

The results show that the detergent bases according to the invention have, even when polluted by oil or water hardness, the foam properties desired by detergent manufacturers, i.e. at the start of the washing operation some foam is formed, which on the one hand persists throughout the entire washing process but on the other hand is not severe, in order to prevent overflowing from the washing machine.

What is claimed is:

1. A detergent base which is a reaction product of a) 5 to 13% by weight of an ethylenically unsaturated sulfonic acid or carboxylic acid or anhydride thereof, b) 50 to 90% by weight of a nonionic surfactant of the formula $$R_1\text{—O-(alkylene-O)}_{n_1}\text{—}R_2 \quad (1)$$

in which $R_1$ is $C_8$–$C_{22}$alkyl or $C_8$–$C_{18}$alkenyl;

$R_2$ is hydrogen; $C_1$–$C_4$alkyl; a cycloaliphatic radical having at least 6 C atoms or benzyl;

"alkylene" is an alkylene radical having 2 to 4 carbon atoms; and $n_1$ is a number from 1 to 60; and c) 0 to 30% by weight of a sugar derivative selected from monosaccharides, disaccharides, trisaccharides and oligosaccharides, the sum of a), b) and c) being 100% by weight and the weight ratio of a)/b) being 8:1 to 4:1, and which contains no further nonionic surfactants.

2. A detergent base according to claim 1, in which the.(alkylene-O) chains in formula (1) are divalent radicals of the formulae $$-(CH_2-CH_2-O)-,\quad -(\overset{CH_3}{\overset{|}{C}}H-CH_2-O)-\quad \text{or}$$

$$-(CH_2-\overset{CH_3}{\overset{|}{C}}H-O)-.$$

3. A detergent base according to claim 1, in which the nonionic surfactant has the formula (2)

$$R_3-O-(\overset{Y_1}{\overset{|}{C}}H-\overset{Y_2}{\overset{|}{C}}H-O)_{n_2}-(\overset{Y_3}{\overset{|}{C}}H-\overset{Y_4}{\overset{|}{C}}H-O)_{n_3}-R_4$$

in which $R_3$ is $C_8$–$C_{22}$alkyl;

$R_4$ is hydrogen or $C_1$–$C_4$alkyl;

$Y_1$, $Y_2$, $Y_3$ and $Y_4$, independently of one another are hydrogen, methyl or ethyl;

$n_2$ is a number from 0 to 8; and $n_3$ is a number from 2 to 40.

4. A detergent base according to claim 1, in which the nonionic surfactant has the formula (3)

$$R_5-O-(\overset{Y_5}{\overset{|}{C}}H-\overset{Y_6}{\overset{|}{C}}H-O)_{n_4}-(\overset{Y_7}{\overset{|}{C}}H-\overset{Y_8}{\overset{|}{C}}H-O)_{n_5}-R_6$$

in which $R_5$ is $C_9$–$C_{14}$alkyl;

$R_6$ is $C_1$–$C_4$alkyl;

$Y_5$, $Y_6$, $Y_7$ and $Y_8$, independently of one another are hydrogen, methyl or ethyl, where one of the radicals $Y_5$, $Y_6$ or $Y_7$, $Y_8$ is always hydrogen; and $n_4$ and $n_5$, independently of one another are an integer from 4 to 8.

5. A detergent base according to claim 1, in which a monocarboxylic acid having 3 to 5 carbon atoms is used as the ethylenically unsaturated carboxylic acid.

6. A detergent base according to claim 5, in which methacrylic acid or acrylic acid is used as the monocarboxylic acid.

7. A detergent base according to claim 1, in which an enolizable saccharide or sugar acid is present and is used as the sugar derivative.

8. A detergent base according to claim 7, in which gluconic acid is used as the sugar derivative.

9. A detergent base according to claim 1, which is obtained from 5 to 13% by weight of acrylic acid or methacrylic acid and 50 to 90% by weight of the nonionic surfactant of the formula (2) and 0 to 30% by weight of gluconic acid.

10. A detergent base according to claim 1, wherein the reaction of a), b) and c) is carried out in the presence of a catalyst which forms free radicals and at a temperature of 30° to 100° C.

11. A detergent base according to claim 10, in which potassium persulfate is used as the catalyst.

12. A domestic detergent comprising:

(a) 5 to 35% by weight of a detergent base which is a reaction product of $a_1$) 5 to 13% by weight of an ethylenically unsaturated sulfonic acid or carboxylic acid or anhydride thereof, $a_2$) 50 to 90% by weight of a nonionic surfactant of the formula $$R_1\text{—O-(alkylene-O)}_{n_1}\text{—}R_2 \quad (1)$$

in which $R_1$ is $C_8$–$C_{22}$alkyl or $C_8$–$C_{18}$alkenyl;

$R_2$ is hydrogen; $C_1$–$C_4$alkyl; a cycloaliphatic radical having at least 6 C atoms or benzyl;

"alkylene" is an alkylene radical having 2 to 4 carbon atoms; and $n_1$ is a number from 1 to 60; and $a_3$) 0 to 30% by weight of a sugar derivative selected from monosaccharides, disaccharides, trisaccharides and oligosaccharides, the sum of a), b) and c) being 100% by weight and the weight ratio of a)/b) being 8:1 to 4:1, (b) 7 to 46% by weight of zeolite or sodium tripolyphosphate, (c) 2 to 6% by weight of sodium silicate or laminar silicate, if appropriate impregnated with cationic softener, (d) 0.8 to 1.2% by weight of carboxymethylcellulose (CMC), (e) 0.2 to 0.6% by weight of phosphonate, (f) 5 to 15% by weight of sodium carbonate, (g) 15 to 25% by weight of sodium perborate compounds, (h) 3 to 5% by weight of peroxide activator, (i) 0.5 to 2% by weight of dye transfer inhibitors, (k) 5 to 17% by weight of sodium citrate, (l) 0.01 to 2% by weight of additives and to 100%, water.

13. A domestic detergent according to claim 12, which additionally comprises (n) 0 to 2% by weight of magnesium silicate, (o) 0 to 25% by weight of sodium sulfate and (p) 0 to 0.5% by weight of foam inhibitors.

* * * * *